US005692326A

United States Patent [19]

Mohan et al.

[11] Patent Number: 5,692,326

[45] Date of Patent: Dec. 2, 1997

[54] SHIRT PRESSING APPARATUS WITH MOVABLE CUFF CLAMPS

[75] Inventors: Manohar Mohan, Cincinnati; Sarupinder Gill, Westchester, both of Ohio

[73] Assignee: American Laundry Machinery, Inc., Cincinnati, Ohio

[21] Appl. No.: 660,430

[22] Filed: Jun. 7, 1996

[51] Int. Cl.[6] ..... D06F 71/16; D06F 71/40

[52] U.S. Cl. ..... 38/7; 38/12; 38/66; 223/71; 223/72

[58] Field of Search ..... 38/10, 12; 223/70, 223/72, 73, 68

[56] References Cited

U.S. PATENT DOCUMENTS

| | | | |
|---|---|---|---|
| 418,918 | 1/1890 | Liebscher . | |
| 821,364 | 5/1906 | Jessel . | |
| 1,476,887 | 12/1923 | Heerey . | |
| 1,845,268 | 2/1932 | Harvey . | |
| 2,353,741 | 7/1944 | Matthews et al. . | |
| 2,504,910 | 4/1950 | Wellington . | |
| 2,715,986 | 8/1955 | Ebner | 223/73 |
| 2,740,566 | 4/1956 | Glover, Jr. . | |
| 2,969,897 | 1/1961 | Paris . | |
| 3,216,633 | 11/1965 | Paris . | |
| 3,567,083 | 3/1971 | Piilola . | |
| 3,568,900 | 3/1971 | Paris . | |
| 3,719,311 | 3/1973 | Remizrz . | |
| 5,474,216 | 12/1995 | Harrod et al. . | |

FOREIGN PATENT DOCUMENTS

| | | |
|---|---|---|
| 1557767 | 1/1969 | France . |
| 320970 | 9/1971 | U.S.S.R. . |

OTHER PUBLICATIONS

Unipress Brochure, *CSF-V Combination Single Buck Vacuum Body and Sleeve Press*, 1994.

*Primary Examiner*—Ismael Izaguirre
*Attorney, Agent, or Firm*—Bacon & Thomas

[57] ABSTRACT

A shirt pressing apparatus includes a buck upon which a shin can be loaded before transferring the buck into a cabinet for pressing and finishing of the shirt. Movable with the buck is a pair of rods which have attached thereto cuff clamps. In accordance with the invention, each of the cuff clamps includes a pair of longitudinally chamfered pinch bars which are mounted in a clamp housing and biased into engagement with each other. The pinch bars are preferably made of Teflon™ and are readily replaceable when worn. The cuff portions of the shirts to be pressed are loaded between the pinch bars of the cuff clamps from below while the rods are located adjacent the buck. Thereafter, the rods are extended away from the buck to place sleeves of the shirt in tension during the pressing and finishing operation. When the shirt is finished and comes out of the cabinet, the rods remain in their extended positions during unloading of the shirt.

19 Claims, 6 Drawing Sheets

SHIRT PRESSING APPARATUS WITH MOVABLE CUFF CLAMPS

BACKGROUND OF THE INVENTION

1. Field of the Invention

The invention relates to method and apparatus for clamping shirt sleeves on a pressing machine designed to finish the bosom, body, side, yoke and sleeve areas of a shirt concurrently.

2. Description of the Background Art

Presently, in the field of finishing shirts, a machine for pressing the bosom, body, yoke and sleeves exists which utilizes top loading, metal clamps for loading the shirt sleeves, arms for extending the clamps away from the shirt and steam and pressurized, heated air to condition and finish the shirt sleeves. The area of the sleeve which contacts the cuff is held by the clamp and the sleeve is extended in slight tension away from the shirt body. Steam and heated, pressurized air enter the sleeve through the opening at the shirt body. All other openings of the sleeve must be closed to allow the pressurized, heated air to inflate the sleeve to its natural form for finishing.

The prior art requires the machine operator to place one side of the sleeve gusset over the other, and then mount the sleeve in the clamp while moving the gusset against the overlap, disturbing the original placement. In addition, the prior art machines are loaded and unloaded from the top, and undue operator fatigue can result from continually lifting sleeves above the clamping mechanism. Unloading from the top requires clamps and arms to move inward toward the shoulder area of the shirt at the end of the finishing cycle while the sleeves are still warm which sets wrinkles into the sleeves. Furthermore, prior art machines use round steel tubing to grip the sleeves which increases contact between the clamps and the sleeves, and do not adapt to shirt sleeves of different thicknesses.

Therefore, there exists a need in the art to improve and preserve the quality of a finished sleeve, improve operator efficiency and reduce operator fatigue while providing a sleeve clamping mechanism for a shirt pressing machine which adapts to varied shirt thicknesses.

SUMMARY OF THE INVENTION

It is an object of the present invention to provide an improved shirt pressing arrangement which overcomes the inadequacies of the prior art devices and which is a significant contribution to the advancement of the art.

Another object of the present invention is to provide a means of clamping a shirt sleeve in such a way that it can be unloaded from the bottom, thus allowing the operator to efficiently undress the shirt sleeve from the clamp with the clamp in the extended position, preserving the body and sleeve finish of the warm shirt at the end of the pressing cycle.

A further object of the present invention is to provide a loading advantage. With the operator sliding the shirt sleeve upward into the clamp, operator fatigue is reduced and the overlapped gusset area remains intact.

A further object of the present invention is to provide a guide for inserting the shirt sleeve to prevent inadvertent loading of a shirt cuff into the clamp which would mar the finish already pressed into the cuff.

A still further object of the present invention is to provide a milled edge of nylon which grips the shirt sleeve, thus reducing unfinished sleeve area by minimizing contact between the clamp and the sleeve.

Another object of the present invention is to improve sleeve forming and finishing by providing a uniform pressure along the shirt sleeve which seals the sleeve end of the shirt and obstructs the flow of steam and heated, pressurized air during finishing, regardless of shirt thickness.

In addition, it is an object of the present invention to provide a clamp which is constructed of spring loaded, nylon pieces which can be replaced after normal wear without replacing the entire clamping mechanism.

These and other objects of the invention are achieved by providing a method and apparatus for concurrently pressing the front, back, side, yoke and sleeve areas of a shirt utilizing a clamping mechanism which allows the shirt to be unloaded with the sleeve extending rods extended, thus preserving the sleeve and body finish at the end of the pressing cycle. The press is comprised of two stations, a loading station where the operator loads and unloads the shirt from a mannequin form and a pressing station. The mannequin, also referred to as a buck, travels between the stations by means of an air cylinder moving a carriage which rolls on rails. Attached to the carriage are the sleeve extending rods, a collar clamping mechanism and the buck. The pressing station is located inside a cabinet. It houses two flat, steam heated, chrome plates called heads. The pressing heads are positioned adjacent to the buck and close and squeeze against the buck to press and finish the bosom and body of the shirt. The yoke and side areas of the shirt are finished by heated air blown through porous air bags located on either side and top of the buck. This heated air forms and dries the yoke and side areas of the shirt. The heated air is provided through a heat exchanger, hoses and discharge chamber in a clamper box which diverts a blower air path to provide initial air to form the shirt, pressurized air to dry and finish the shirt or no air to the buck side and yoke air bags. When no air is provided, it is exhausted from the press via an exhaust muffler. Concurrently the intake side of the blower is used to draw the shirt against the buck in the front tail area to hold it in place during transfer. A buck cavity, hoses, filters and an intake chamber in the clamper box are used to provide vacuum to hold the shirt at the dressing station and during buck transfer into the cabinet. The intake chamber includes a means for diverting the negative air between the buck and the inlet filters, provides a means of turning vacuum on and off to the buck at the dressing station, and structure to automatically turn the vacuum off in the pressing station. The shirt sleeves are clamped closed at the cuff ends and finished by extending the sleeves and then injecting steam and heated, pressurized air which first relaxes the shirt fibers and then forms, dries and finishes the sleeves. A blower and heat exchanger dedicated to sleeve finishing is used for the delivery of heated air to the sleeves.

Additional objects, features and advantages of the invention will become more readily apparent from the following detailed description of a preferred embodiment thereof when taken in conjunction with the drawings wherein like references numerals refer to corresponding parts in the several views.

DETAILED DESCRIPTION OF THE PREFERRED EMBODIMENT

Figure 1:
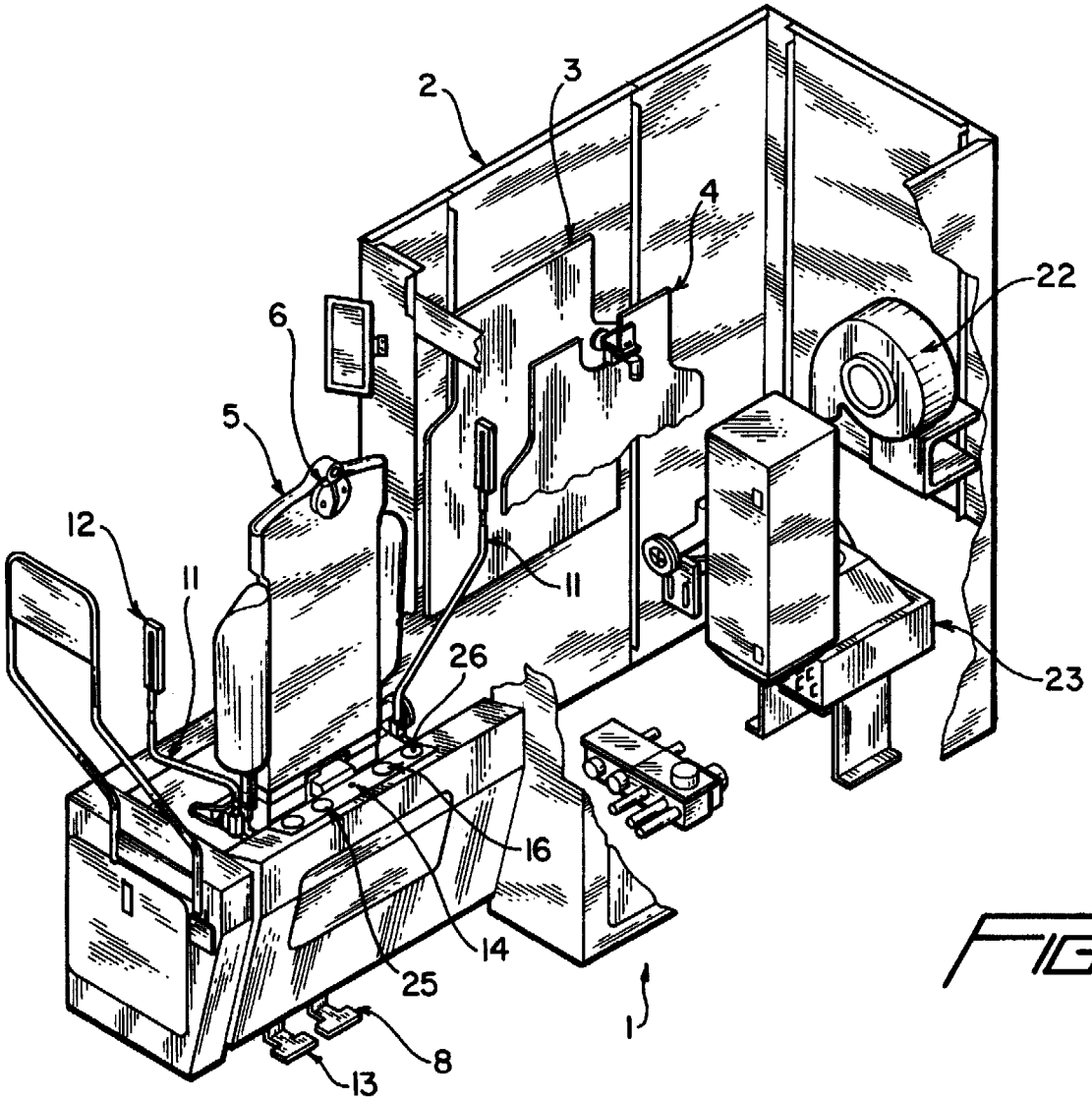
FIG. 1 is a perspective view of the shirt pressing apparatus of the invention, viewed from the front, left corner, near a loading station.
Figure 2A:
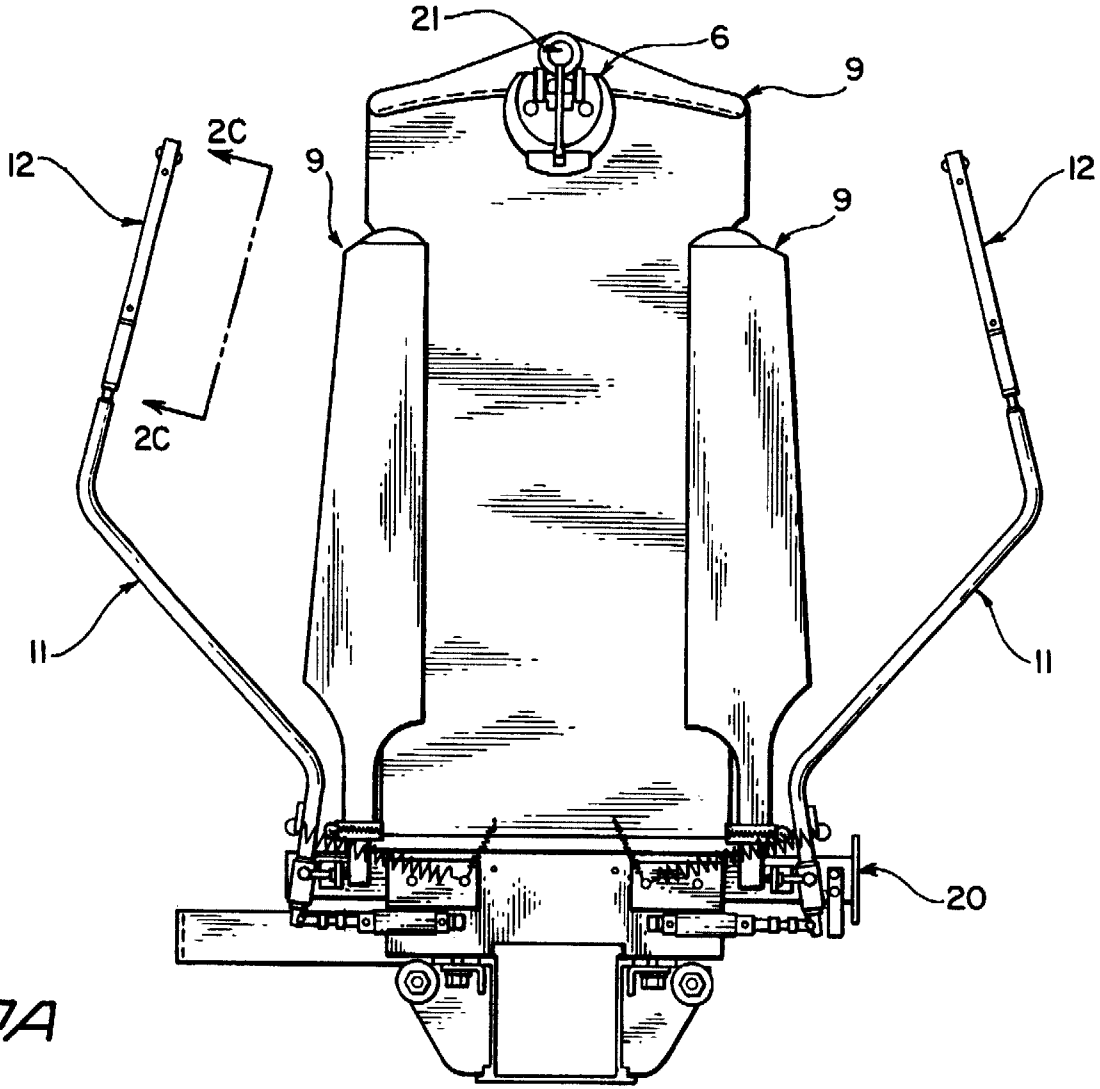
FIG. 2A is an elevational view of a sub-assembly of the pressing apparatus including a buck, carriage and sleeve extending rods shown in a retracted position.
Figure 2B:
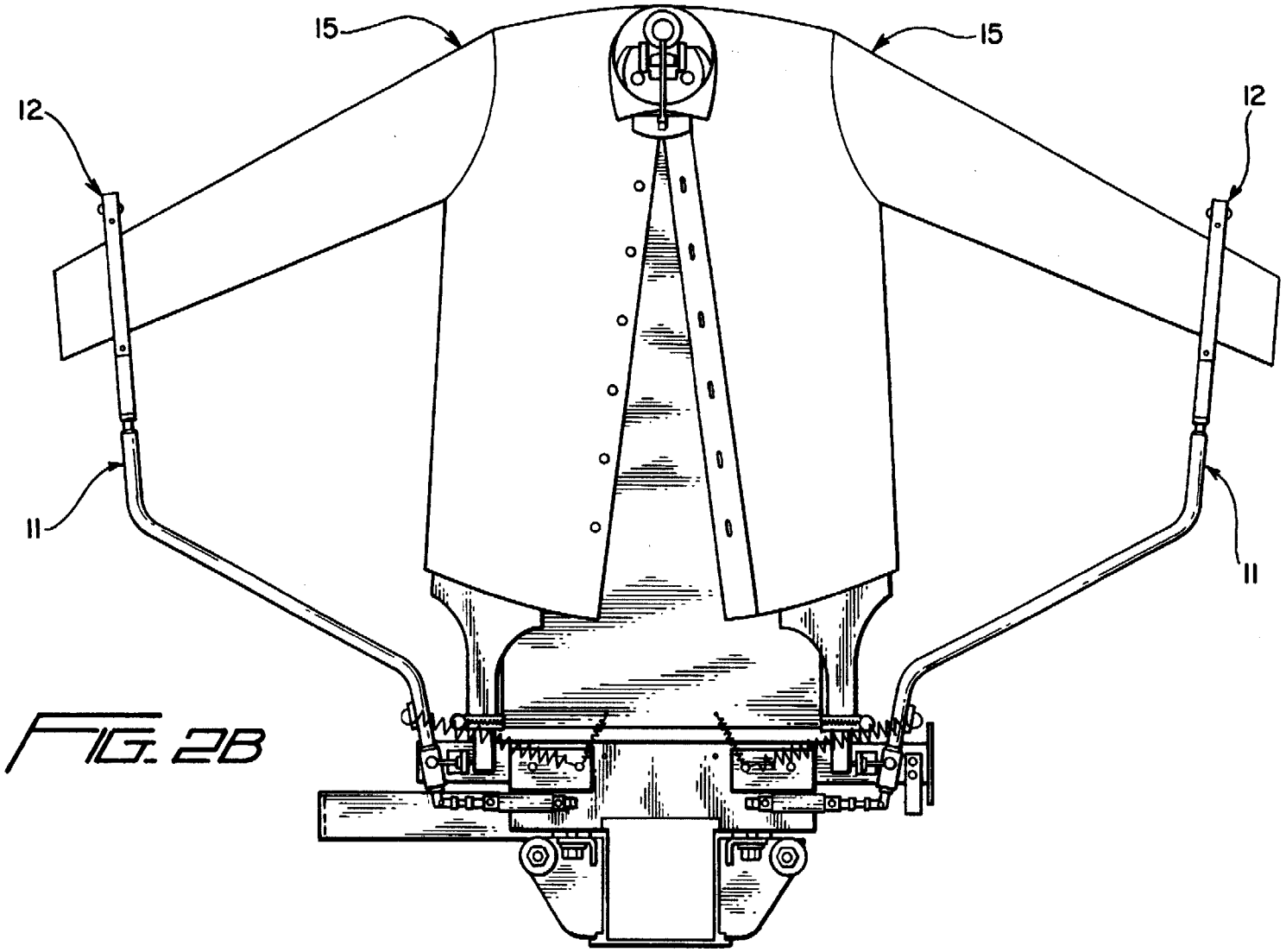
FIG. 2B is an elevational view of a shirt dressed on the sub-assembly of FIG. 2A with the sleeve extending rods in the extended position.
Figure 3B:
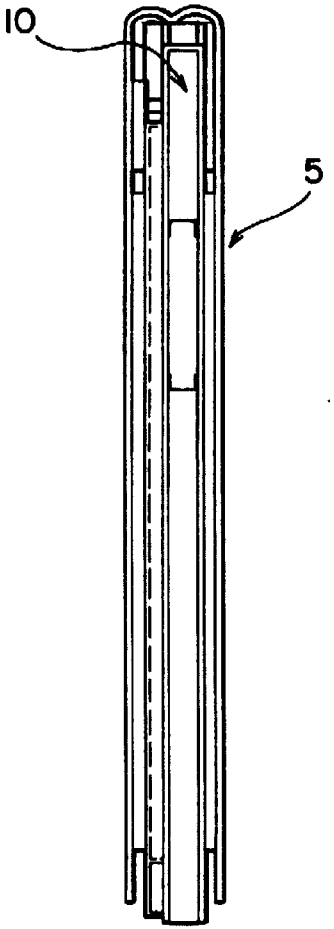
FIG. 3B is a side view of the partially padded buck.
Figure 3A:
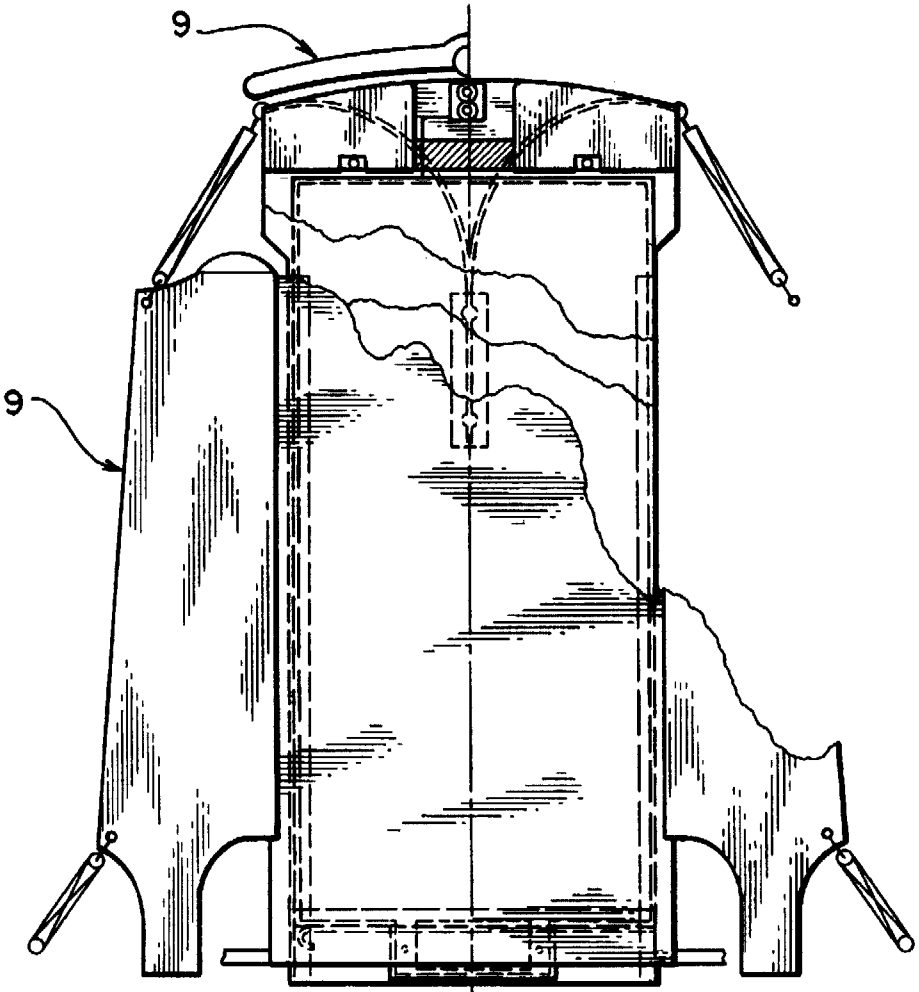
FIG. 3A is an elevational view of the padded buck.

The shirt pressing apparatus of the invention is indicated at 1 in FIG. 1 and is designed to finish the front, back, sides, yoke and sleeves of a long sleeved shirt simultaneously. The shirt pressing apparatus 1 includes a cabinet 2 which preferably houses two chrome plated steel, steam heated, flat pressing heads 3 and 4, one for pressing the front body of a shirt and one for pressing the rear body of a shirt. A shirt mannequin, also referred to as a buck 5, is preferably constructed from aluminum. The lower ⅓ of the front of the buck 5 is comprised of a vacuum chamber having holes 7 (see FIG. 4) used to hold a front tail part of a shirt to the buck 5. At the top of the buck 5 is a pneumatic collar clamp 6 which is actuated by a foot pedal 8 to hold a front collar area of a shirt. The buck 5 is externally padded such as with steel base pads, flannel underpads and a cover with sewn in porous side and yoke air bags 9 (see FIGS. 2A and 3A). A cavity 10 (FIG. 3B) inside the buck 5 directs steam and heated air to finish the shirt sleeve. Two sleeve extending rods 11 are utilized to extend sleeves for finishing. An elongated clamp 12 on the end of each rod 11 holds the sleeve in place and seals the end of the shirt and a foot pedal 13 aids in controlling the positioning of clamps 12 as will be discussed more fully below.

A pneumatic drive system (not shown) is adapted to move the buck from a loading station as shown in FIG. 1 to a finishing station inside the cabinet 2. The drive system is designed to automatically return the buck 5 to the loading station either when a pneumatic stop button 16 is pushed or when a cycle timer runs out. As the drive system is not considered part of the invention, it will not be further discussed herein.

Figure 4:
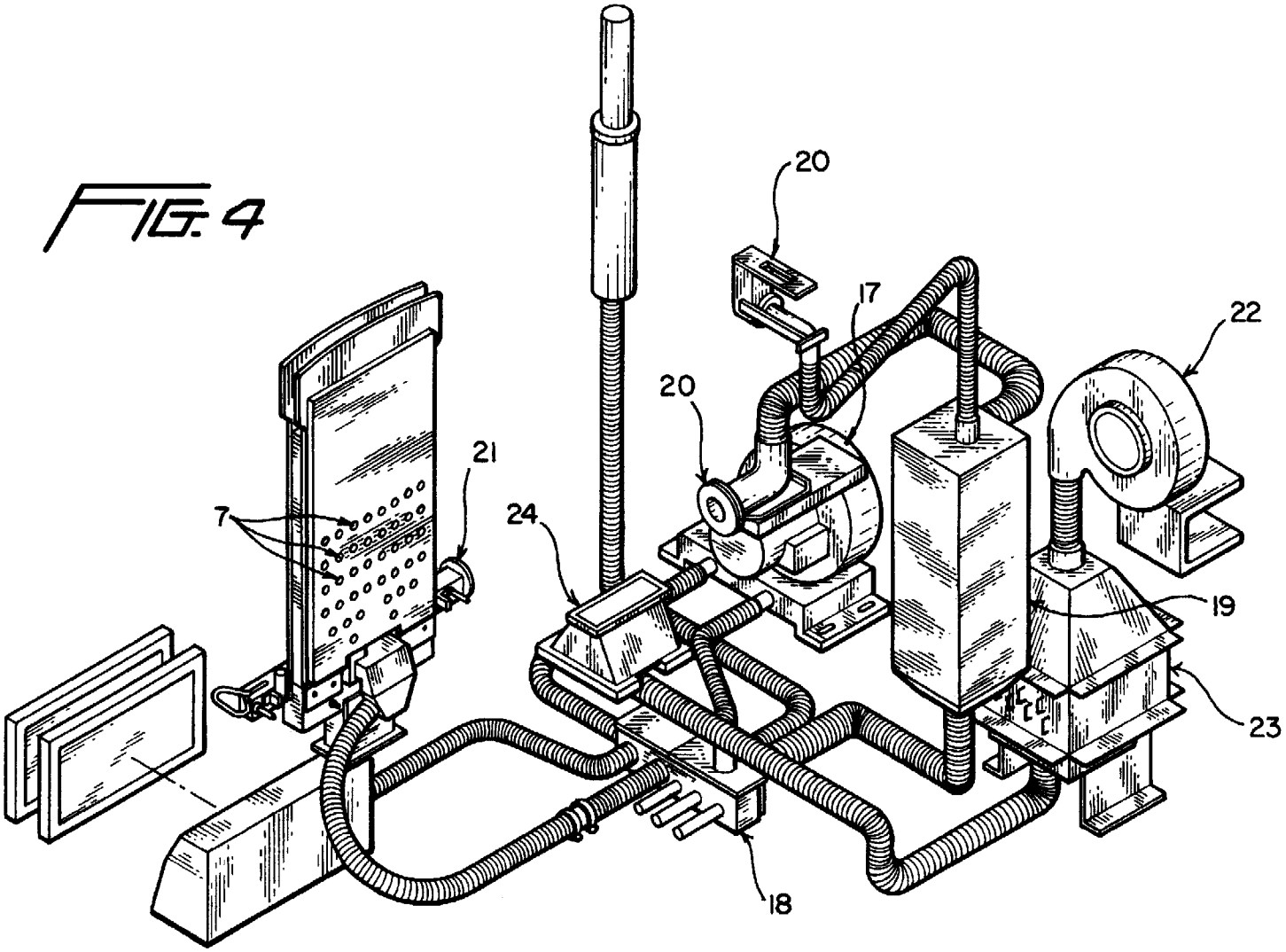
FIG. 4 is a three dimensional representation of the buck without padding, a blower and related parts for finishing the shirt yoke, sides and sleeves.

Referring to FIG. 4, a single continuous running dual purpose blower 17 is used in conjunction with a double chamber clamper box 18, heat exchanger 19, various hoses (not separately labeled), discharge spouts 20, receiving tubes 21 and the porous air bags 9 mentioned above to direct ambient air for holding, forming and finishing the shirt. One blower 22 which cycles off and on is used to finish the shirt sleeves and dry steam is used to condition the shirt sleeves before they are formed and dried. When sleeve conditioning is finished, the blower 22 turns on and remains on throughout the pressing cycle. The blower 22 moves air through a heat exchanger 23 and into the buck cavity 10 via a discharge box 24 and hoses as shown. The heated air exits the buck cavity 10 at openings (not separately labeled) in the buck 5 near the shirt sleeve area. The cuff clamp 12 seals the cuff area of the shirt so the air is forced through the shirt sleeves. This forms and finishes the sleeves. Therefore, the pressing apparatus 1 utilizes a source of steam to the front head 4, rear head 3, sleeve heat exchanger 23 and air bag heat exchanger 19. Although not individually shown or considered part of the present invention, peripheral equipment which aids in finishing shirt is provided standard on the pressing apparatus 1, including a spray gun to moisten shirts when required and a mirror which provides operator visibility to the rear of the shirt.

The sequence of operation of pressing apparatus 1 involves: operator loading of an unfinished shin; transfer of the loaded shirt into the pressing cabinet 2; shin finishing within the pressing cabinet 2; transfer of the loaded shirt from the pressing cabinet 2; and unloading the finished shirt. In reference to the first main operational step, the operator loads and centers the body of a shirt onto the buck 5, using collar clamp foot pedal 8 to insert the shirt neck band into collar clamp 6. Once the body of the shirt is dressed onto the buck 5, the operator pushes button 14 which causes the sleeve extending rods 11 to swing inward toward the buck 5 for ease of dressing. The operator then grasps one sleeve with the gusset facing him and overlaps the gusset and cuff as if buttoning the cuff. The end of the sleeve is now closed. The operator then turns the cuff so that the gusset is facing away from him and slides the closed sleeve upward into the respective sleeve clamp 12 just below the cuff seam, taking care not to twist the shoulder or cuff areas of the sleeve. The same steps are followed with the other sleeve. Then, stepping on foot pedal 13 causes the sleeve extending rods 11 to swing away from the sides of the buck 5 and simultaneously turns a vacuum to buck 5 to hold the tail of the shirt in place. This places the sleeves 15 in tension, thus forming them for finishing. The operator then presses and releases buttons 25 and 26 which sends the loaded buck 5, including sleeve extending rods 11, into the pressing cabinet 2 for finishing. At the end of the pressing cycle or when the stop button 16 is pressed, the finished shirt on the buck 5 is automatically delivered to the loading station. The sleeve extending rods 11 remain extended and the operator unloads the sleeves downward. Unloading in a downward direction with the sleeves still extended allows the sleeve to be removed without disturbing the finish of the body or sleeve of the shirt which have just been pressed and are still warm.

Figure 2C:
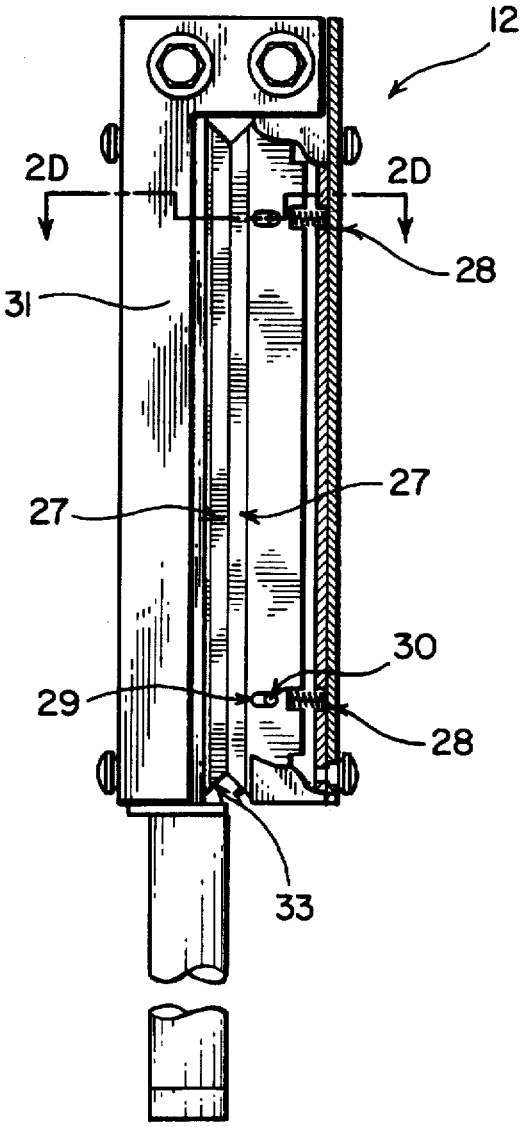
FIG. 2C is an elevational view of a sleeve clamping mechanism incorporated in the pressing apparatus as taken along line 2C—2C of FIG. 2A.
Figure 2D:
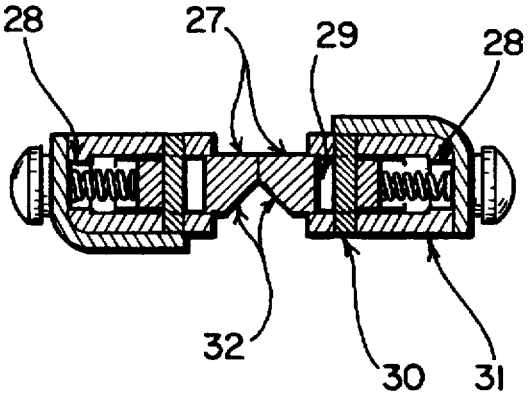
FIG. 2D is a sectional view of the sleeve clamping mechanism taken along line 2D—2D of FIG. 2C.

In accordance with the preferred embodiment as shown in FIGS. 2C and 2D, the sleeve clamp 12 holds the shirt sleeve between two spring-loaded, Teflon™ (polytetrafluoroethylene) pinch bars 27. Each bar 27 utilizes two springs 28, one positioned near the top and one positioned near the bottom which also engage an outer clamp housing 31 and apply a uniform pressure along the entire length of the bar 27 to bias the bars 27 towards one another. The bars themselves are provided with horizontal slots 29 to allow a clearance for roll pins 30 which are inserted through the slots 29 and then are fixed in either side of the clamp housing 31 to act as guides and prevent the bars 27 from moving in a vertical direction during sleeve dressing and while undressing allowing the bars 27 to move in a horizontal direction to accommodate different shirt thicknesses.

Each bar 27 is chamfered at 32 to assure minimal contact with the shirt sleeve. A radius 33 on each Teflon™ pinch bar 27 acts as a guide for inserting the sleeve. The shirt sleeves are loaded into and unloaded from the bottom of the clamp to maximize sleeve quality and operator efficiency and minimize operator fatigue.

The finishing or pressing cycle begins when the buck 5 comes to a stop inside the pressing cabinet 2 and the front head 4 (see FIG. 1) doses. Initial low pressure air is delivered to the buck air bags 9, the rear head 3 doses, then high pressure air is delivered to the buck air bags 9 and vacuum turns off to the buck 5. Electrical timers are activated and dry steam is supplied to the shirt sleeves for the amount of time set on the timer. Once the steam timer times out, the sleeve blower 22 is energized and blows heated air to finish the shirt sleeves until the pressing cycle times out or is interrupted through another means at which time the press heads open.

From the above description, it should be apparent that the shirt pressing apparatus 1 of the invention provides a simple and effective structure for pressing shirts of varying sizes while enhancing the quality of the finished product and minimizing operator fatigue. In particular, the construction of the clamps 12 and the manner in which shirts are loaded and unloaded from the pressing apparatus 1 assures that varying sized shirts can be easily and effectively pressed while any required maintenance of the clamp elements can be readily carried out to maintain a uniform, quality pressing operation over the life of the pressing apparatus 1.

Although described with respect to a preferred embodiment of the invention, it should be readily understood that various changes and/or modifications may be made without departing from the spirit of the invention. In general, the invention is only intended to be limited by the scope of the following claims.

We claim:

1. A shirt pressing apparatus comprising:

a cabinet housing at least one shirt pressing unit;

a buck for receiving a shirt to be pressed is, said buck being movable between a loading station located outside said cabinet and a pressing station located inside said cabinet;

a pair of movable sleeve extending rods connected to said buck for concurrent movement therewith between said loading and pressing stations; a device connected to the rods for controlling their motion relative to said buck between a shirt sleeve loading position whereat an end portion of each of said rods is located a first distance from said buck; a pressing position and an unloading position; the end portion of each of said rods being located a second distance from said buck at said pressing and unloading positions, said second distance being greater than said first distance and corresponding to a distance suitable to maintain a loaded shirt sleeve tensioned during pressing and unloading of a shirt in and from the pressing apparatus; and first and second cuff clamps each of which is attached to a respective said end portion of said rods for receiving cuff portions of a shirt to be pressed.

2. The shirt pressing apparatus according to claim 1, each of said cuff clamps including a clamp housing and first and second pinch bars mounted therein, each of said pinch bars having upper and lower ends with the lower ends being openable to receive a shirt cuff upwardly between said pinch bars for loading a shirt sleeve cuff into said cuff clamps.

3. The shirt pressing apparatus according to claim 2, further comprising a biasing device, acting between said pinch bars and said clamp housing, arranged to resiliently urge said pinch bars toward each other.

4. The shirt pressing apparatus according to claim 3, wherein said biasing device comprises a plurality of springs arranged at spaced longitudinal locations within said clamp housing.

5. The shirt pressing apparatus according to claim 4, wherein said pinch bars have an associated longitudinal axis, said springs being arranged substantially perpendicular to said longitudinal axis.

6. The shirt pressing apparatus according to claim 2, wherein said pinch bars include longitudinally extending outer edge portions which are chamfered.

7. The shirt pressing apparatus according to claim 2, wherein said pinch bars are made of a polytetrafluoroethylene material.

8. The cuff pressing apparatus according to claim 2, wherein said pinch bars are formed with plural, vertically spaced and generally horizontally extending slots and said clamp housing includes multiple pin members, each of which extends within a respective one of said slots.

9. A cuff clamp for use in a shirt pressing apparatus comprising:

a clamp housing adapted to be attached to a sleeve extending rod of a shirt pressing apparatus;

first and second pinch bars mounted in said clamp housing, each of said pinch bars having upper and lower ends, said lower ends being openable to receive a shirt cuff upwardly between said pinch bars; and a biasing device, acting between said pinch bars and said clamp housing arranged to resiliently urge said pinch bars toward each other.

10. The cuff clamp according to claim 9, wherein said biasing device comprises a plurality of springs arranged at spaced longitudinal locations within said housing.

11. The cuff clamp according to claim 10, wherein said pinch bars have an associated longitudinal axis, said springs being arranged substantially perpendicular to said longitudinal axis.

12. The cuff clamp according to claim 9, wherein said pinch bars include longitudinally extending outer edge portions which are chamfered.

13. The cuff clamp according to claim 9, wherein said pinch bars are made of a polytetrafluoroethylene material.

14. The cuff clamp according to claim 9, wherein said pinch bars are formed with plural, vertically spaced and generally horizontally extending slots and said clamp housing includes multiple pin members each of which extends within a respective one of said slots.

15. A method of pressing a long-sleeve shirt in shirt pressing apparatus comprising:

loading a body portion of an unfinished shirt onto a buck of the apparatus;

inserting cuff portions of the unfinished shirt within cuff clamps attached to sleeve extending rods of the apparatus while the sleeve extending rods are in a retracted position adjacent to the buck, said inserting being carried out in an upward direction from below the clamps;

shifting the sleeve extending rods to an extended position away from the buck such that sleeve portions of the unfinished shirt are extended relative to the body portion of the unfinished shirt and placed in tension;

transferring the buck, the sleeve extending rods and the unfinished shirt into a pressing cabinet of the apparatus;

finishing the shirt in the pressing cabinet;

transferring the buck, the sleeve extending rods and the finished shirt out of the pressing cabinet; and unloading the finished shirt by removing the cuff portions thereof in a downward direction from the cuff clamps while the sleeve extending rods are maintained in the extended position and removing the body portion of the finished shirt from the buck.

16. The method of pressing a long-sleeve shirt according to claim 15, further comprising providing the cuff clamps with longitudinally chamfered pinch bars between which the cuff portions can be retained.

17. The method of pressing a long-sleeve shirt according to claim 16, further comprising biasing the pinch bars toward one another.

18. The method of pressing a long-sleeve shirt according to claim 16, further comprising making the pinch bars of a polytetrafluoroethylene material and removably mounting the pinch bars in a housing of each of the cuff clamps such that the pinch bars can be readily replaced when worn.

19. The method of pressing a long-sleeve shirt according to claim 16, further comprising preventing vertical movement while permitting limited horizontal movement of the pinch bars relative to a housing of a respective cuff clamp.

* * * * *